US010357830B2

(12) United States Patent
Andreussi et al.

(10) Patent No.: US 10,357,830 B2
(45) Date of Patent: Jul. 23, 2019

(54) METHOD FOR THE PRODUCTION OF AN ELEMENT SUBJECT TO WEAR, ELEMENT SUBJECT TO WEAR AND TEMPORARY AGGREGATION STRUCTURE TO PRODUCE SAID ELEMENT SUBJECT TO WEAR

(75) Inventors: Alberto Andreussi, Tricesimo (IT); Primo Andreussi, Reana del Rojale (IT); Enrico Veneroso, Udine (IT); Eddy Pontelli, Tricesimo (IT)

(73) Assignee: F.A.R.—Fonderie Acciaierie Roiale—SpA, Reana del Rojale (IT)

( * ) Notice: Subject to any disclaimer, the term of this patent is extended or adjusted under 35 U.S.C. 154(b) by 958 days.

(21) Appl. No.: 13/809,385

(22) PCT Filed: Jul. 8, 2011

(86) PCT No.: PCT/IB2011/001581
§ 371 (c)(1),
(2), (4) Date: Jan. 15, 2013

(87) PCT Pub. No.: WO2012/004654
PCT Pub. Date: Jan. 12, 2012

(65) Prior Publication Data

US 2013/0115475 A1 May 9, 2013

(30) Foreign Application Priority Data

Jul. 9, 2010 (IT) ..... UD2010A0135

(51) Int. Cl.
*B22F 7/04* (2006.01)
*B22D 19/00* (2006.01)
(Continued)

(52) U.S. Cl.
CPC ..... *B22F 7/04* (2013.01); *B22D 19/0081* (2013.01); *B22D 19/02* (2013.01); *B22D 19/06* (2013.01);
(Continued)

(58) Field of Classification Search
CPC .... B22D 18/02; B22D 19/02; B22D 19/0081; B22F 7/04; B22F 2007/045; C22C 33/0242; Y10T 428/249957
See application file for complete search history.

(56) References Cited

U.S. PATENT DOCUMENTS 5,041,248 A * 8/1991 Renlund ..... C04B 35/62227 264/210.6
5,052,464 A 10/1991 Natori
(Continued)

FOREIGN PATENT DOCUMENTS

DE 1 949 777 10/1970
EP 0 368 781 A1 5/1990
(Continued)

OTHER PUBLICATIONS

B. Mondal, S. Kundu, A.K. Lohar, B.C. Pai, Net-shape manufacturing of intricate components of A356/SiCp composite through rapid-prototyping-integrated investment casting, Materials Science and Engineering: A, vol. 498, Issues 1-2, Dec. 20, 2008, pp. 37-41, ISSN 0921-5093.*
(Continued)

*Primary Examiner* — Colleen P Dunn
*Assistant Examiner* — Jeremy C Jones
(74) *Attorney, Agent, or Firm* — Calderone Bullock LLC

(57) ABSTRACT

The method for the production of an element subject to wear, comprising a metal matrix and at least a core of hard material. The method provides a first step in which a temporary aggregation structure is prepared with at least partly open pores, which volatilize or in any case eliminate at least partly when subjected to heating. A second step in which, on the whole internal and external surface of said temporary aggregation structure, a liquid mixture of a binder with metal powders which contain hard elements or their precursors is uniformly distributed. A third step in which the
(Continued)

temporary aggregation structure is deteriorated by means of a thermal action of controlled heating, so as to take at least part of the temporary aggregation structure to evaporation, rendering free a volume inside the core, and to consolidate the mixture according to the conformation of the temporary aggregation structure. A fourth step in which the core is disposed in a mold so as to only partly occupy the free volume of the mold. A fifth step in which a molten metal material is cast in the mold, which metal occupies the free volume and the volume that has been made free, both inside and outside the core, so as to anchor to the latter and thus form a single body.

10 Claims, 2 Drawing Sheets

(51) Int. Cl.
*B22D 19/02* (2006.01)
*B22D 19/06* (2006.01)
*C22C 33/02* (2006.01)

(52) U.S. Cl.
CPC ... *C22C 33/0242* (2013.01); *Y10T 428/12042* (2015.01); *Y10T 428/249957* (2015.04)

(56) References Cited

U.S. PATENT DOCUMENTS 5,385,195 A * 1/1995 Bell ..... C22C 49/14 164/100
5,679,041 A * 10/1997 Sokol ..... B22F 3/22 442/59
5,730,915 A * 3/1998 Cornie ..... B22C 1/00 164/23
6,103,397 A * 8/2000 Sugimoto ..... B22F 3/11 428/558
6,387,149 B1 * 5/2002 Harada ..... B22F 3/1137 419/14
6,582,812 B1 * 6/2003 Grylls ..... B22F 7/006 428/307.7
6,776,219 B1 8/2004 Cornie et al.
2001/0046563 A1 * 11/2001 Nakamura ..... C04B 35/573 427/376.2
2005/0229746 A1 * 10/2005 Juma ..... C04B 38/0022 75/407
2007/0128462 A1 * 6/2007 Andreussi ..... B22C 1/00 428/577
2008/0193738 A1 * 8/2008 Hensley ..... C08J 9/32 428/308.4
2008/0241579 A1 * 10/2008 Kinney ..... B22D 19/0009 428/637
2010/0009163 A1 * 1/2010 Lindemann ..... B22D 19/02 428/320.2

FOREIGN PATENT DOCUMENTS

EP 0 369 928 A1 5/1990
EP 0 480 850 A1 4/1992
EP 0 574 620 A1 12/1993
EP 0 575 685 A1 12/1993
WO 98/15373 A1 4/1998
WO 2005/018854 A1 3/2005

OTHER PUBLICATIONS

Lange, F. F., Velamakanni, B. V. and Evans, A. G. (1990), Method for Processing Metal-Reinforced Ceramic Composites. Journal of the American Ceramic Society, 73: 388-393.*
Filmon, Robert; Retailleau-Gaborit, Nadine; Brossard, Guenaelle; Grizon-Pascaretti, Florence; Basle,. "Microct and preparation of [beta]-TCP granular material by the polyurethane foam method." The Free Library Jun. 1, 2009. Jan. 8, 2016.*
K. Lemster, M. Delporte, T. Graule, J. Kuebler, Activation of alumina foams for fabricating MMCs by pressureless infiltration, Ceramics International, vol. 33, Issue 7, Sep. 2007, pp. 1179-1185.*
Brown, D. D. and Green, D. J. (1994), Investigation of Strut Crack Formation in Open Cell Alumina Ceramics. Journal of the American Ceramic Society, 77: 1467-1472.*
Mondal, B. et al., "Net-Shape Manufacturing of Intricate Components of A356/$SiC_p$ Composite through Rapid-Prototyping-Integrated Investment Casting", *Materials Science and Engineering*, 498, pp. 37-41 (2008).
Previtali, B. et al., "Application of Traditional Investment Casting Process to Aluminium Matrix Composites", *Composites: Part A*, 39, pp. 1606-1617 (2008).
PCT International Search Report and Written Opinion of the International Searching Authority, 11 pages.

* cited by examiner

METHOD FOR THE PRODUCTION OF AN ELEMENT SUBJECT TO WEAR, ELEMENT SUBJECT TO WEAR AND TEMPORARY AGGREGATION STRUCTURE TO PRODUCE SAID ELEMENT SUBJECT TO WEAR

BACKGROUND OF THE INVENTION

Field of the Invention

The present invention concerns a method for the production of an element subject to wear, such as a tool used for the crushing or for the abrasion of mineral substances, masses of building debris, metal waste or other similar treatments, and an element subject to wear obtained by said method.

The present invention also concerns an intermediate support structure used as a base in the preliminary production steps of the element subject to wear, and the core obtained with the temporary aggregation structure.

Description of Related Art

Several methods are known for the production of an element subject to wear, in which the element substantially comprises a metal matrix which confers great rigidity and robustness to the element, and one or more cores of ceramic material having a high resistance to abrasion.

One known method provides to make an element subject to wear by means of casting or centrifuging a molten metal material on an insert, or biscuit, made of ceramic material, disposed in a mold.

However, this type of known method does not allow to obtain elements having mechanical characteristics such as to be able to use in any application or sector, even those more exacting both in terms of stress, and also in terms of intensity and continuity of stress, and which require hardness, toughness and resistance to temperatures which cannot be obtained with the known methods.

Another known method provides to cast the molten metal material on a ceramic insert of metal oxide and/or metal carbide, which is preformed with a perforated structure made by sintering or heat pressure, so that, during the casting, the molten metal material can penetrate into the apertures and into the interstices of the insert itself.

This second type of method has, however, high production costs, in particular but not only, for the production and the pre-molding of the ceramic insert, which has to be sintered according to a desired form of use.

Moreover, since a sintering process is needed to keep the ceramic powders in a desired conformation, there is a limited possibility of molding the insert, so that conformations are made which are excessive or reduced with respect to the optimal.

This disadvantage brings, in some cases, an increase in production costs, and in other cases, a reduction in the good quality of the element made.

An element subject to wear is also known starting from powders, for the formation of titanium carbide using the heat of the metal material in the casting step of the matrix.

BRIEF SUMMARY OF THE INVENTION

One purpose of the present invention is to perfect a method to obtain elements subject to wear, such as a mechanical member, an abrasion or crushing tool or similar, which have high resistance to wear, an excellent toughness and are able to resist considerable stresses, including heat stresses and prolonged stresses.

Another purpose of the present invention is to perfect a method to obtain elements subject to wear, with reduced costs, greater precision in conformation of the insert and increased mechanical quality with respect to known methods.

A further purpose is to make a structure which allows to produce an element subject to wear which has great hardness and great toughness and is able to overcome the shortcomings of elements made according to the known state of the art, both in terms of production costs and in terms of mechanical quality.

The Applicant has devised, tested and embodied the present invention to overcome the shortcomings of the state of the art and to obtain these and other purposes and advantages.

The present invention is set forth and characterized in the independent claims, while the dependent claims describe other characteristics of the invention or variants to the main inventive idea.

In accordance with the above purpose, a method for the production of an element subject to wear comprising a metal matrix and at least a core of hard material, provides:

- a first step in which a temporary aggregation structure is prepared with at least partially open pores and which has the characteristic that it is volatilized or in any case at least partly eliminated when it is subjected to heating;
- a second step in which, on the whole internal and external surface of the temporary aggregation structure, a mixture of a binder with metal powders which contain hard elements or their precursors is uniformly distributed;
- a third step in which said temporary aggregation structure is deteriorated by means of a thermal action of controlled heating, so that the temporary aggregation structure at least partly evaporates making an internal volume of the core free, while the mixture consolidates according to the conformation of said temporary aggregation structure;
- a fourth step in which the core is disposed in a mold so as to only partly occupy the free volume of the mold; and
- a fifth step in which a molten metal material is cast in said mold, which metal material occupies the free volume, and that which has been made free, both inside and outside the core, so as to be anchored to the latter and thus form a single body.

According to the invention the core has a geometric conformation coherent with the requirements of the finished element, or of all the sectors of the finished element.

According to the invention, the temporary aggregation structure has a structure of intercommunicating open pores of the spongy type, disposed in the structure in a random or organized way.

In this way the mixture of liquid binder with the metal powders is made to impregnate inside the temporary aggregation structure and thus covers practically every recess present therein.

According to a first variant, the impregnation of the mixture inside the temporary aggregation structure occurs by elastically crushing the structure itself, immersing it into the liquid mixture and leaving it to expand elastically inside it.

According to another variant, the temporary aggregation structure is introduced into an ambient where a vacuum is first created and then the mixture introduced.

With the present invention the molten metal material penetrates both into the interstices created by the interconnected holes and also into those which are generated by the elimination of the temporary aggregation structure, enveloping at least partly the metal powders, or in any case keeping them in the reticular position originally provided and defined.

According to a variant, if the hard elements or their precursors are carbon or even include carbon, they achieve reticular structures with increased hardness or hard particles by a chemical-physical reaction in contact with the molten metal material.

According to this variant, a structure is made with a core which has continuity but with variations in hardness in a reticular form defined by the metal material cast.

Making the temporary aggregation structure in spongy material with intercommunicating open pores, such as a reticule, entails both costs and production times which are considerably lower than known solutions in which the whole core, and not only its support, is made by sintering powders of oxides and/or metal carbides.

According to a first formulation of the invention, the reticular structure of the communicating holes can be random.

According to another formulation the reticular structure can develop in an organized way according to three or more axes.

A further advantage of the solution according to the present invention is given by the possibility of conforming the core in a more simple and precise way compared with known solutions, so as to guarantee great precision in obtaining the hard zones of the element subject to wear.

Moreover, with the invention, the conformation of the core can be made easily.

It is also possible to provide in the space the density of the products or of the hard compounds even varying the type of the temporary aggregation structure, or by combining structures with different holes.

According to a variant the support structure is made of a metal material, such as malleable cast iron or similar.

According to another variant, the support structure is made of a polymeric material, such as a thermosetting plastic.

In this way the metal powders are easily manipulated and suitable to be kept in the correct and defined position and conformation, with respect to the volume of the element subject to wear, up to the casting step, so as to stay in that position and conformation even at the end of casting.

In the variant in which the temporary aggregation structure is made of a metal material, this melts at least partly and consolidates the mixture of powders, keeping them in the initial disposition, that is, before their deterioration, making a free volume inside the core.

Instead, in the variant in which the support structure is made of a polymeric material, this melts substantially completely and leaves only the mixture of powders, in the original disposition.

According to another variant, at the end of the casting step a heat treatment step is provided, in which the element subject to wear is subjected to at least a heat treatment in order to confer determinate mechanical and structural characteristics on it.

The metal material with which the matrix is made is advantageously iron based, even if this characteristic is not essential for the present invention. In the case of material with an iron base, it is manganese steel, martensitic or others. According to a variant it is chromium cast iron or other similar material.

According to another variant of the present invention, before the casting of the metal material is carried out, both the sand mold and also the internal core are kept at an ambient temperature and do not have to be heated, thus allowing a considerable reduction in costs in setting up and feeding the heating apparatuses.

BRIEF DESCRIPTION OF THE SEVERAL VIEWS OF THE DRAWINGS

These and other characteristics of the present invention will become apparent from the following description of a preferential form of embodiment, given as a non-restrictive example with reference to the attached drawings wherein.

Figure 1:
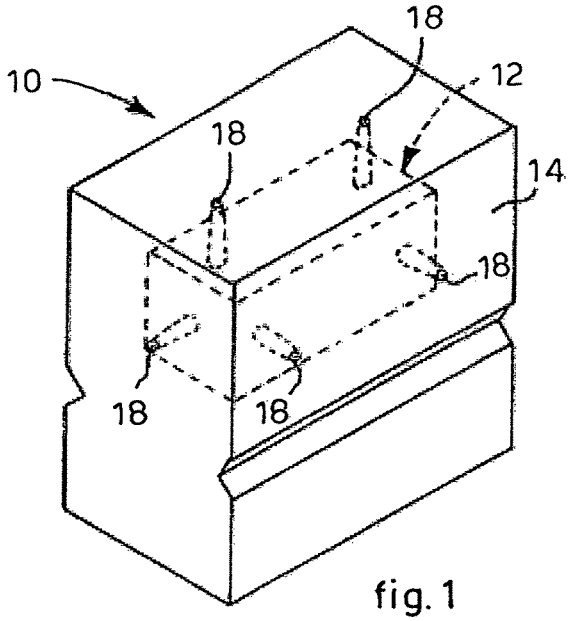
FIG. 1 is a three-dimensional view of an element subject to wear according to the present invention.

To facilitate comprehension, the same reference numbers have been used, where possible, to identify identical common elements in the drawings. It is understood that elements and characteristics of one form of embodiment can conveniently be incorporated into other forms of embodiment without further clarifications.

DETAILED DESCRIPTION OF THE INVENTION

With reference to FIG. 1, a method according to the present invention for the production of an element 10 subject to wear, such as a mechanical member, an abrasion or crushing tool or similar, comprising a core 12, or panel, of hard material and a metal matrix 14, provides a step of preparing and molding the core 12, in which a temporary aggregation structure 17 is prepared on which a mixture of a liquid binder and metal powders which contain hard elements or their precursors, such as for example titanium, chromium, tungsten, molybdenum or others in a single or combined form, are aggregated.

The mixture is uniformly aggregated both on the internal surface and also on the external surface of the temporary aggregation structure 17, which has an open intercommunicating pore structure, of the spongy type.

The mixture can consist of two or more metal powders, according to different percentages of mix in weight so as to obtain, on each occasion, a core 12 having determinate characteristics of toughness, heat dilation, resistance to abrasion and others, depending on the type of application for which the element 10 is intended.

The temporary aggregation structure 17 is made of polymeric material, in this case, polymeric foams. However, it cannot be excluded that it can be made of any other similar or comparable material, which evaporates if subjected to heating.

In an alternative form of embodiment, the temporary aggregation structure 17 is made of metal material.

In any case, the temporary aggregation structure 17 has a geometric reticule conformation coherent with that which is to be given to the core 12, so as to precisely maintain the metal powders in determinate zones of the volume of the mold 16 and therefore of the element 10 once casting has been carried out.

In this case the mixture provides to use suitable glues, advantageously from 1% to 3% in weight, with respect to the metal powders provided.

One example provides that the temporary aggregation structure 17 is soaked in a compressed condition in a bath of mixture and then released, so that the mixture penetrates into the pores of the temporary aggregation structure 17, being distributed in a substantially uniform way onto the temporary aggregation structure 17 and inside the intercommunicating open pores.

Figure 2A:
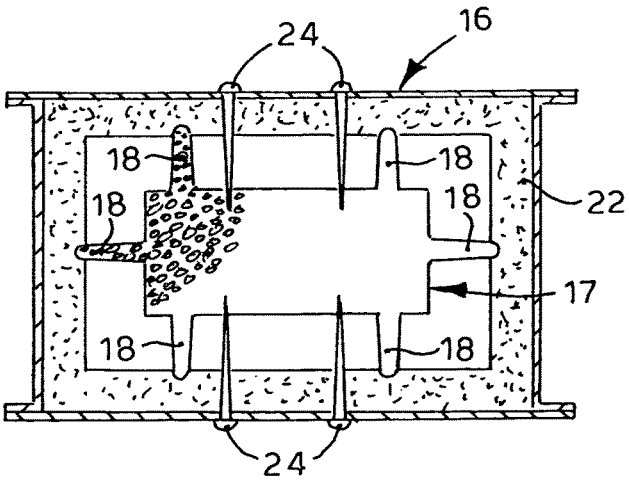
FIG. 2*a* is a cross section of a sand mold in a first step of the method to make the element in FIG. 1.

As shown schematically in FIG. 2*a*, in this condition each segment of the temporary aggregation structure 17 is externally enveloped by the mixture of powders 13, kept together and in aggregation to the temporary aggregation structure 17 by the layer of glue 15.

In the preliminary molding step of the core 12, spacer elements 18 are provided, in one piece or a single body, which are disposed uniformly on the external surface of the temporary aggregation structure 17.

In the following first step, the temporary aggregation structure 17 with the mixture of aggregated powders is inserted inside the sand mold 16 for casting, so that the spacers 18 are stably positioned in corresponding lateral walls 22 of the mold 16.

The spacers 18 have substantially a double advantage: they confer on the temporary aggregation structure 17 a self-bearing characteristic, avoiding the need for a bearing framework inserted at the center of the temporary aggregation structure 17, with the advantage of reducing the production costs and times; they define a correct position of the temporary aggregation structure 17, determining a free volume around the core 12 inside the mold 16.

Before effecting the casting of the molten metal material inside the mold 16, the temporary aggregation structure 17 is deteriorated thermally, for example by taking the temporary aggregation structure 17 with the mixture of aggregated powders, from a temperature comprised between about 50° C. and about 150° C., advantageously about 100° C., up to a temperature comprised between about 300° C. and about 800° C., advantageously between about 500° C. and about 700° C., with a gradient comprised between about 0.5° C./h and about 3° C./h, advantageously between about 1° C./h and about 2° C./h.

In the solution in which the temporary aggregation structure 17 is made of polymeric material, the temperatures reached are sufficient to determine a substantially complete melting and evaporation of the temporary aggregation structure 17, so that at the end of the controlled heating a volume inside the core 12 remains free and only the mixture of metal powders remains in the initial conformation conferred originally by the temporary aggregation structure 17.

In the solution in which the temporary aggregation structure 17 is made of metal material, the temperatures reached are sufficient to determine a partial melting of the temporary aggregation structure 17, so that at the end of the controlled heating a volume inside the core 12 remains free and the melted part acts as a binder to keep the mixture of metal powders in the initial conformation conferred originally by the temporary aggregation structure 17.

The molten metal material is therefore cast, through a casting channel, not shown in the drawings, so as to penetrate inside the interstices of the spongy structure of the core 12, so as to envelop the powders or possibly react with them.

In the variant solution in which the initial support structure 17 was made of metal, the remaining part of the temporary aggregation structure 17 melts together with the metal material cast.

This condition determines the amalgamation of the core 12 inside the matrix 14 forming a single body of the two parts, in which there is a structural continuity but with variations in hardness in correspondence with the reticular disposition of the powders, according to the spongy conformation of the temporary aggregation structure 17.

Figure 3A:
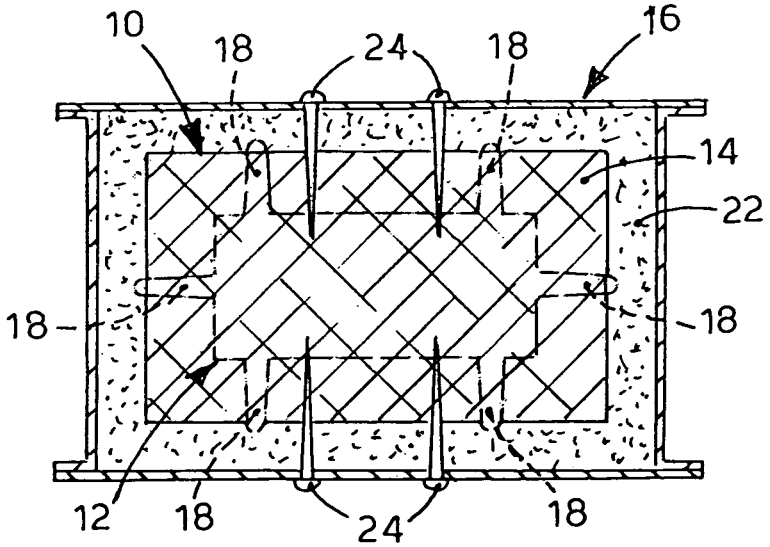
FIG. 3*a* is a cross section of a sand mold in a second step of the method to make the element in FIG. 1.

Simply to give an example, in FIG. 3*a* a hypothetical shaping of the core 12 inside the matrix 14 is shown by a line of dashes, while the section signs, which have been deliberately extended, go to ideally define a communion zone between the core 12 and the matrix 14.

Figure 2B:
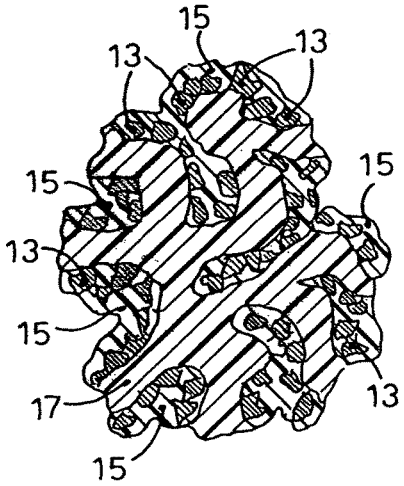
FIG. 2*b* is an enlarged schematic section of a part of the temporary aggregation structure.
Figure 3B:
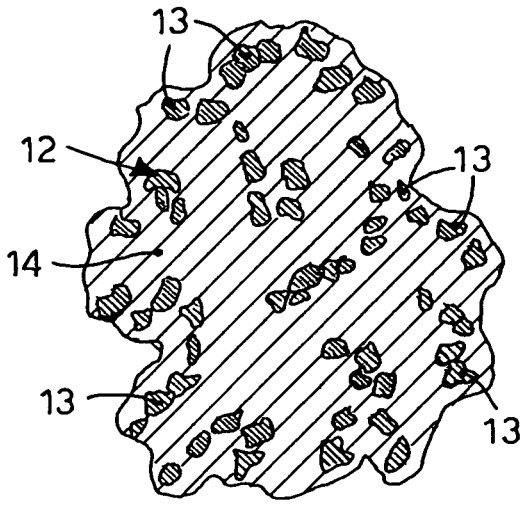
FIG. 3*b* is an enlarged schematic section of a part of the temporary aggregation structure.

In FIG. 3*b* the same sectioned part as in FIG. 2*b* is shown, but after the casting of the metal material making up the matrix 14.

As can be seen from a comparison, the metal material 14 has completely taken the place of the temporary aggregation structure 17 and of the layer of glue 15. The position of the powders 13 remains, instead, reticular and substantially unchanged according to the disposition originally defined by the temporary aggregation structure 17.

Advantageously the sand of the mold 16 is made up of olivine, that is, iron and magnesium silicate, which does not develop free silica, and does not therefore cause silicosis, and is particularly suitable for the casting of molten metal material.

The temporary aggregation structure 17 can also be temporarily attached to the mold 16 by means of attachment elements 24, such as nails, screws or similar, which are disposed between the temporary aggregation structure 17 and the walls 22 in order to firmly anchor the temporary aggregation structure 17 in the position defined by the spacers 18.

Both the temporary aggregation structure 17 and the mold 16 are at ambient temperature before casting is carried out.

The molten metal material is, in this case, a mix of martensitic steel. Alternatively chromium cast iron is used.

In this case, the element 10 is cooled slowly in the mold to a temperature of less than 300° C., this in order to reduce internal tensions; it is then dug out and subjected to hardening at about 950-1,100° C., preferably at 1,000° C., for a determinate period of time, depending on the thickness of the element 10, and cooled in forced air, or in water or according to other known methods. In a preferential solution, during hardening the element 10 is progressively heated for about 10 hours up to 950-1,100° C., following a determinate temperature ramp, and then kept at temperature for about 2-6 hours.

After cooling the element 10 is worked, in order to carry out flattening, leveling or other workings so that it can then be assembled on a crushing member, such as for example the rotor of a mill. The element 10 shown in the drawings has a substantially parallelepiped shape for example, but it is clear that this shape is not limiting for the present invention, because it depends on the subsequent application of the element 10.

It is clear that modifications and/or additions of steps or parts may be made to the method, the temporary aggregation structure 17 and the element subject to wear 10 as described heretofore, without departing from the field and scope of the present invention.

It is also clear that, although the present invention has been described with reference to some specific examples, a person of skill in the art shall certainly be able to achieve many other equivalent forms of method for the production of an element subject to wear, element subject to wear and temporary aggregation structure for the production of the element subject to wear, having the characteristics as set forth in the claims and hence all coming within the field of protection defined thereby.

We claim:

1. A method for the production of an element subject to wear comprising a metal matrix and at least a core of hard material, wherein the method comprises:

a first step in which a temporary aggregation structure is a spatial reticular structure that has open and intercommunicating pores, and is able to volatilize or be at least partially eliminated when subjected to heating, and in which the spatial reticular structure geometrically conforms in a coherent manner to the geometric conformation of the core;

a second step in which, on the whole internal and external surface of said temporary aggregation structure, a liquid mixture of a binder with metal powders which contain hard elements or their precursors is uniformly distributed, and in which the temporary aggregation structure is immersed in the liquid mixture in an elastically compressed form and then released, such that the temporary aggregation structure is soaked in a compressed condition in a bath of the liquid mixture and is then released;

a third step in which said temporary aggregation structure is deteriorated by means of a thermal action of controlled heating, so as to take at least part of said temporary aggregation structure to evaporation or partial melting, forming the core with a free volume therein, wherein the liquid mixture is consolidated according to the conformation of said temporary aggregation structure;

a fourth step in which said core is disposed in a mold so as to only partly occupy the free volume of the mold;

a fifth step in which a molten metal material is cast in said mold, which metal occupies the free volume and the volume that has been made free, both inside and outside said core, so as to anchor to the latter and thus form an element subject to wear having a single body, wherein prior to the casting of said molten metal material, both said core and said mold are at ambient temperature and wherein the metal powders undergo a chemical-physical reaction when contacting the molten metal material; and a sixth step in which said element is subjected to tempering.

2. The method as in claim 1, wherein during the second step the temporary aggregation structure is subjected to vacuum action and then the liquid mixture is introduced.

3. The method as in claim 1, wherein, during said third step in which the core is formed, the deterioration provides a heating of the temporary aggregation structure from a temperature comprised between about 50° C. to about 150° C. to a temperature comprised between about 300° C. and about 800° C. with a gradient comprised between about 0.5° C./h and about 3° C./h.

4. The method as in claim 3, wherein the heating of the temporary aggregation structure is from a temperature of about 100° C. to a temperature between about 500° C. and about 700° C.

5. The method as in claim 3, wherein the heating of the temporary aggregation structure has a gradient comprised between about 1° C./h and about 2° C./h.

6. The method as in claim 1, wherein, during said first step, on the external surface of the temporary aggregation structure, spacer elements are present which protrude from said external surface.

7. The method as in claim 1, wherein, during the fourth step, before the casting of said molten metal material, the core is clamped by means of attachment elements which are anchored between walls of said mold and said core.

8. The method as in claim 1, wherein the element subject to wear is selected from the group consisting of a mechanical member, an abrasion tool, and a crushing tool.

9. The method of claim 1, wherein the molten material comprises manganese steel, martensitic steel or chromium cast iron.

10. A method for the production of an element subject to wear comprising a metal matrix and at least a core of hard material, wherein the method comprises:

a first step in which a temporary aggregation structure is prepared with at least partly open pores, and is able to volatilize or be at least partially eliminated when subjected to heating;

a second step in which the temporary aggregation structure is immersed in an elastically compressed form in a bath of a liquid mixture of a binder with metal powders which contain hard elements or their precursors, and is then released such that the liquid mixture is uniformly distributed on the whole internal and external surface of the temporary aggregation structure;

a third step in which said temporary aggregation structure is deteriorated by means of a thermal action of controlled heating, so as to take at least part of said temporary aggregation structure to evaporation or partial melting, forming the core with a free volume therein, wherein the liquid mixture is consolidated according to the conformation of said temporary aggregation structure;

a fourth step in which said core is disposed in a mold so as to only partly occupy the free volume of the mold;

a fifth step in which a molten metal material is cast in said mold, which metal occupies the free volume and the volume that has been made free, both inside and outside said core, so as to anchor to the latter and thus form an element subject to wear having a single body, wherein prior to the casting of said molten metal material, both said core and said mold are at ambient temperature and wherein the metal powders undergo a chemical-physical reaction when contacting the molten metal material; and a sixth step in which said element is subjected to tempering.

* * * * *